US006516950B1

(12) United States Patent
Robertson

(10) Patent No.: US 6,516,950 B1
(45) Date of Patent: Feb. 11, 2003

(54) CREDIT CARD-SIZED CARRIER FOR A MEDICAMENT

(76) Inventor: John A. Robertson, 20702 Rte. 23, Chillicothe, OH (US) 45601

( * ) Notice: Subject to any disclaimer, the term of this patent is extended or adjusted under 35 U.S.C. 154(b) by 0 days.

(21) Appl. No.: 09/563,062

(22) Filed: Apr. 24, 2000

(51) Int. Cl.[7] ..... B65D 83/04

(52) U.S. Cl. ..... 206/539; 206/534; 53/467

(58) Field of Search ..... 206/223, 528, 206/530, 534, 538, 539, 484; 53/467, 473, 485

(56) References Cited

U.S. PATENT DOCUMENTS

| | | | | |
|---|---|---|---|---|
| 2,061,139 A | | 11/1936 | Cohen | |
| 2,317,860 A | | 4/1943 | Sorensen | |
| 2,777,570 A | | 1/1957 | Mytinger | |
| 3,305,077 A | | 2/1967 | Greif et al. | |
| 3,351,192 A | * | 11/1967 | Plante | 206/530 |
| 3,921,804 A | | 11/1975 | Tester | |
| 3,954,179 A | * | 5/1976 | Warmath | 206/528 |
| 4,889,236 A | * | 12/1989 | Bartell et al. | 206/534 |
| 5,325,968 A | | 7/1994 | Sowden | |
| 5,330,055 A | | 7/1994 | Kendra et al. | |
| 5,381,904 A | | 1/1995 | Thurell | |
| 5,584,388 A | * | 12/1996 | Johnson | 206/217 |
| 5,727,687 A | | 3/1998 | Renner | |
| 5,791,478 A | * | 8/1998 | Kalvelage et al. | 206/531 |
| 6,155,409 A | * | 12/2000 | Hettinger | 206/534 |

* cited by examiner

*Primary Examiner*—Luan K. Bui

(57) ABSTRACT

The present invention is directed to a credit card-sized carrier for a medicament. The carrier is composed of a lower housing having a cavity which houses a medicament wafer. The cavity of the lower housing is defined by a flat base and connected sidewalls, which terminate in a flange. A cover is removably attached to the lower housing to enclose the cavity. The carrier may be combined with an instruction card and alert to form a portable medicament kit. The invention also is directed to a method for enabling a person to carry a medicament during everyday including the step of providing a credit card-sized carrier that houses a wafer.

30 Claims, 4 Drawing Sheets

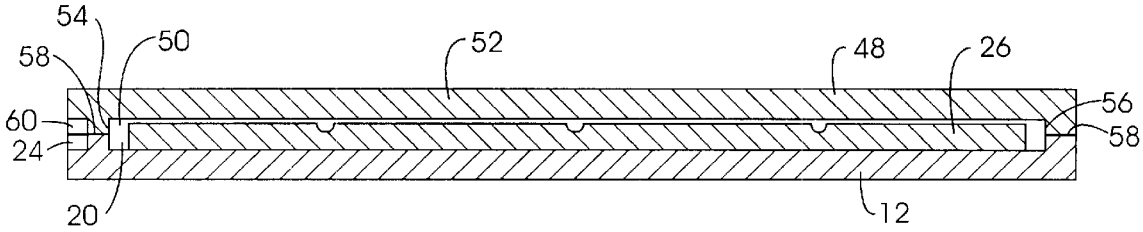
FIG. 6
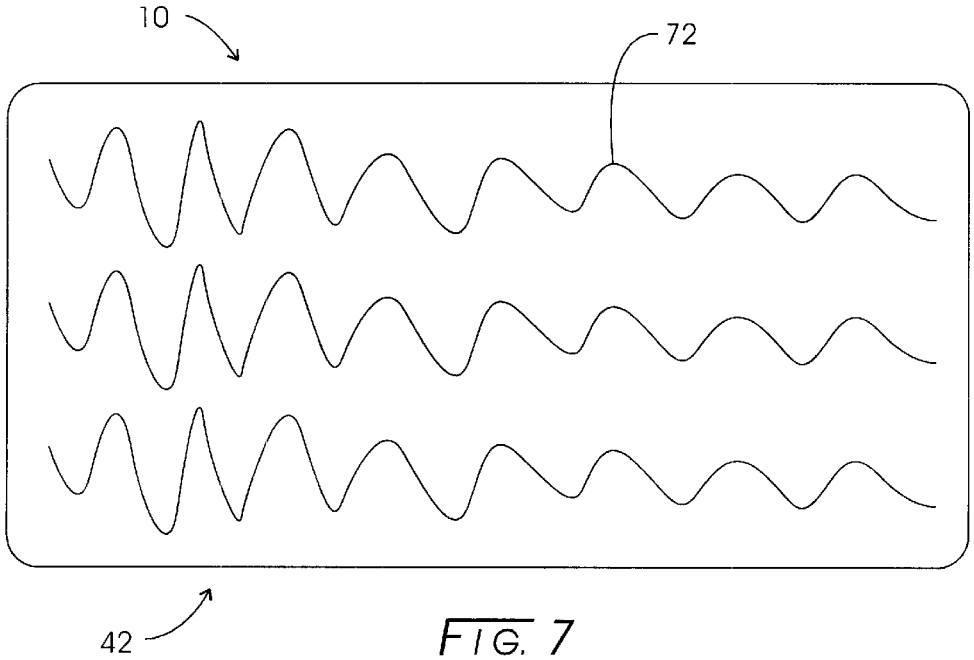
FIG. 7
74
NAME:
AGE:_____ DOB:_____
WEIGHT: _____ PHONE NO:_____
DOCTOR:_____
INCASE OF EMERGENCY CONTACT:_____
_____
KNOWN MEDICAL CONDITION:_____
_____
ALLERGIES:_____
FIG. 8

CREDIT CARD-SIZED CARRIER FOR A MEDICAMENT

CROSS-REFERENCE TO RELATED APPLICATIONS

STATEMENT REGARDING FEDERALLY SPONSORED RESEARCH

Not applicable.

BACKGROUND OF THE INVENTION

Aspirin, or acetylsalicylic acid, is a common household drug that can be found in almost every medicine cabinet in the United States. Aspirin has been used for over one hundred years, having been developed by German chemist Felix Hoffmann in 1897. Most commonly thought of as an analgesic, or pain reliever, it is considered by practitioners and consumers to be an effective, cheap and relatively safe drug. In recent years, however, aspirin also has been discovered to be effective in the treatment of cardiovascular disease, particularly heart attacks. Cardiovascular disease is the leading cause of death in the United States and most developed countries. Generally, there will be 1,250,000 heart attacks every year in the United States with 500,000 of those attacks resulting in death. Therefore, aspirin's ability to prevent and treat persons suffering from cardiovascular disease cannot be overlooked or overvalued.

A heart attack, or myocardial infarction (MI), may be caused by the blockage of blood flow to the heart. Without an adequate supply of oxygen rich blood, affected areas of the heart muscle die, and the pumping action of the heart is either impaired or stops altogether. A diminution of flow of blood to the heart muscle may be caused by the build-up of atherosclerosis, or plaque. A tear in plaque inside a narrowed artery causing platelets to aggregate and form a clot, may cause an acute myocardial infarction. It is not fully understood how aspirin functions to prevent or treat such conditions, but modem theories are based on the work of British pharmacologist John Vane. His research focused on prostaglandins, which are hormone-like substances that influence the elasticity of blood vessels and direct the functioning of blood platelets. It is believed that aspirin blocks the production of prostaglandins, thus, preventing platelets from aggregating and a blood clot from forming.

While scientists continue to more fully understand how aspirin functions, its ability to treat serious cardiovascular conditions has been recognized by the Food and Drug Administration (FDA) since at least 1985. In that year, the FDA approved the use of aspirin to prevent heart attacks in patients who had either suffered a previous heart attack or suffered from unstable angina. This approval was based on studies indicating that use of aspirin lowered the risk of a second heart attack by 20%, and, for persons suffering from unstable angina, reduced the risk of heart attack by 51%. In 1996, a further proposal was made by the FDA to amend professional labeling rules to include acute MI as an indication for aspirin. That proposal was incorporated into a final rule adopted by the FDA in 1998, which became effective Oct. 25, 1999. Adoption of this change was supported by recent studies on aspirin in the treatment of acute MI that were submitted to and considered by the FDA. Specifically, the rule states that, "Aspirin is indicated to (1) Reduce the combined risk of death and nonfatal stroke in patients who have had ischemic stroke or transient ischemia of the brain due to fibrin platelet emboli, (2) reduce the risk of vascular mortality in patients with a suspected acute MI, (3) reduce the combined risk of death and nonfatal MI in patients with a previous MI or unstable angina pectoris, and (4) reduce the combined risk of MI and sudden death in patients with chronic stable angina pectoris."

In light of the FDA's recognition that aspirin can reduce the risk of death if taken at the first signs of a heart attack, it is advantageous for persons who are at risk for a heart attack to have aspirin on hand in the event of a suspected heart attack. This is particularly true for those persons who have a prior history of heart attacks or other cardiovascular disease. Because a heart attack may occur at any time, it would be particularly beneficial for persons to have a convenient carrier or container to store and carry aspirin with them wherever they go. Such a container must be of an appropriate size and shape to be comfortably carried when at home, travelling, exercising, or during any other everyday activity. The contents of the carrier also must be easily accessible, as time is of the essence in an emergency situation.

In addition to being portable and providing immediate access to medication, the carrier also must comply with governmental requirements for a container closure system for packaging a human drug. In this regard, the FDA has promulgated a number of regulations for the control of drug product containers and closures. For example, the current good manufacturing practice (CGMP) requirements for the control of drug product containers and closures are included in 21 C.F.R. Parts 210 and 211. These requirements include the FDA requirement for tamper-resistant closures as indicated in 21 C.F.R. §211.132. The United States Pharmacopeil Convention also has established requirements for containers. In general terms, these standards address a number of issues. For example, containers must protect the contents contained therein, and the materials from which the containers are formed must be compatible with the enclosed drugs. Additionally, the packaging materials must be safely constructed to prevent leakage of undesirable substances into the container. More specifically, with respect to containers for solid oral dosage forms, containers must prevent potential adverse affects of water vapor, which may affect the decomposition rate of the active drug substance or the dissolution rate of the dosage form. This is accomplished by providing a container with an intrinsically low rate of water vapor permutation and an effective seal. Also, the container must protect the drug from light and reactive gases. Depending on the type of drug housed within the container, there may be requirements for indicia on the container including a description of the enclosed drug, instructions regarding dosage, and indications for its use.

BRIEF SUMMARY OF THE INVENTION

The present invention is directed to a thin carrier for storing and transporting a medicament wafer. The carrier includes a lower housing having a cavity formed from a flat base and connected sidewalls that extend to a flange. A medicament wafer rests within the cavity and is enclosed by a cover that is removably attached to the flange.

The lower housing may be made of rigid plastic that protects the medicament, which may be aspirin or any other medicament in wafer form. In one embodiment of the invention, the cover may be planar being formed of a film, foil, laminate, or plastic. In another embodiment, the cover may be an upper housing formed of plastic which, as with the lower housing, has a cavity defined by a base and connected sidewalls that extend to a flange.

One aspect of the present is a method for enabling a person to carry a medicament during everyday activities which includes the step of providing a credit card-sized carrier housing a medicament wafer within a lower housing. The lower housing has a cavity defined by a base and sidewalls that extend to a flange. A cover, removably attached to the flange, encloses the wafer within the lower housing.

Another aspect of the invention is a portable kit that includes a credit card-sized carrier, which houses a medicament wafer, and a patient information card attached to or included within the carrier. An alert to indicate the presence of the carrier on the patient also may be included as part of the kit.

BRIEF DESCRIPTION OF THE DRAWINGS

FIG. 6 is a cross-sectional view of the credit card-sized carrier with the cover shown as an upper housing having a cavity formed by a base and connected sidewalls that extend to a flange;

FIG. 7 is a front view of the carrier that bears indicia;

FIG. 8 is a front view of an instruction card that may be attached to or enclosed within the credit card-sized carrier.

DETAILED DESCRIPTION OF THE INVENTION

Figure 1:
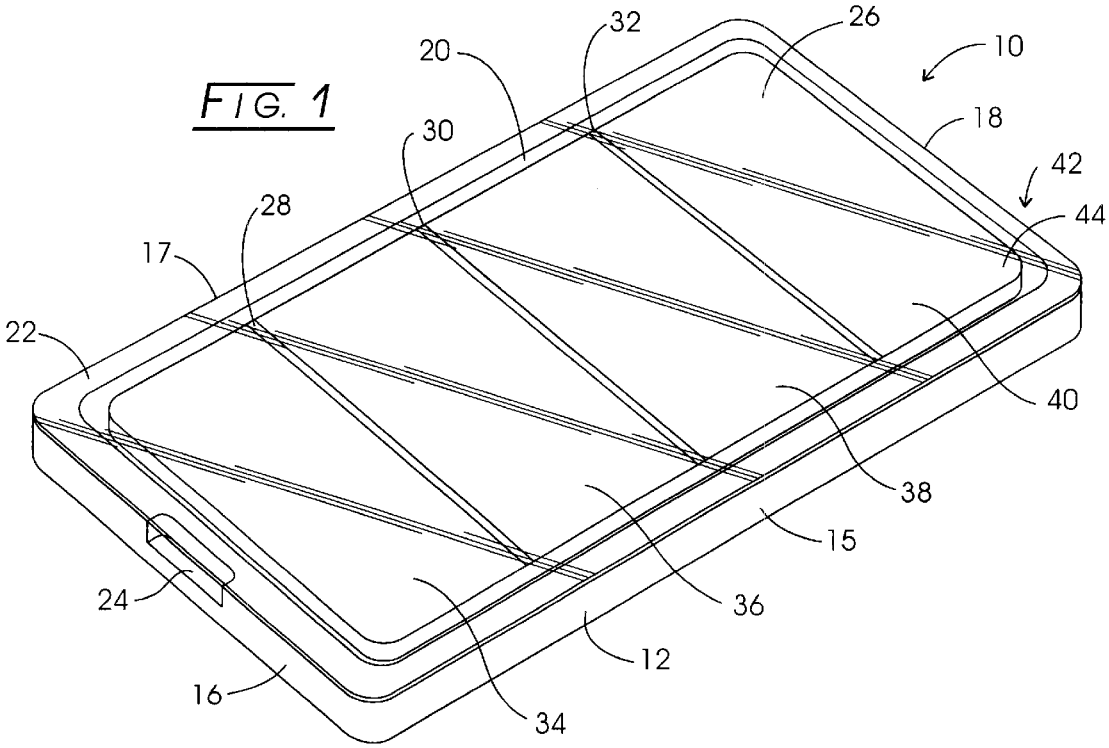
FIG. 1 is a perspective view of the credit card-sized carrier of the invention showing its lower housing, cavity, sidewalls, and cover.

The present invention addresses a credit card-sized carrier for aspirin or other medicament wafer. Throughout this application the term "credit card-sized carrier" is intended to indicate a carrier configured to fit in a credit card holder. At its largest size, the credit card-sized carrier may have a length and width of substantially no greater than about that of a standard credit card and a thickness that is substantially no greater than about two or three times that of a standard credit card. A standard credit card has a length of about 3.5 inches and a width of about 2.25 inches. A credit card also will have a thickness of nominally about 0.05 inches (including embossed or raised lettering). Within the bounds of those upper dimension limitations, however, the dimensions of the carrier may vary. Because of its size and the materials from which it is constructed, the credit card-sized carrier may be readily transported, for example fitting easily in a pocket or wallet, so that the medicament contained therein will be available in case of an emergency.

Looking at FIGS. 1–4, the credit card-sized carrier is shown generally at 10. Carrier 10 includes a lower housing, 12, having a flat base, 14, and connected sidewalls, 15–18. For present purposes, the terms "connected sidewalls" includes straight sides and straight sides with radiused corners, as well as circular, oblong, or other curvilinear geometries. Although used in the plural, the term "sidewalls" also is intended to include the singular. Sidewalls 15–18 extend to a flange, 22, that has a thumb notch, 24. Base 14 and sidewalls 15–18 define a cavity, 20, which holds a medicament wafer, 26. Medicament wafer 26 may be an aspirin wafer or any other drug whose size is preformed commensurate with the dimensions of carrier 10 and which is compatible with the materials forming the carrier. These materials will be described in greater detail below. For present purposes, the term "aspirin" is intended to mean the active ingredient acetylsalicylic acid, either alone or in combination with inert ingredients (e.g. binders) to make medicament wafer 26 in a patient convenient form. Medicament wafer 26 may be segmented by separation lines, such as those shown at 28–32, to provide multiple medicinal doses within a single carrier. With separation lines 28–32 dividing medicament wafer 26, carrier 10 contains four individual doses 34–40. Medicament wafer 26 is enclosed within cavity 20 by a cover, 42, which cover is removably attached to flange 22 of lower housing 12. Shown in FIG. 4, cover 42 is removably attached to flange 22 of lower housing 12 preferably by an adhesive, 43. Materials that may be used as adhesive 43 and other methods by which cover 42 may be removably attached to lower housing 12 are discussed in greater detail below.

Figure 2:
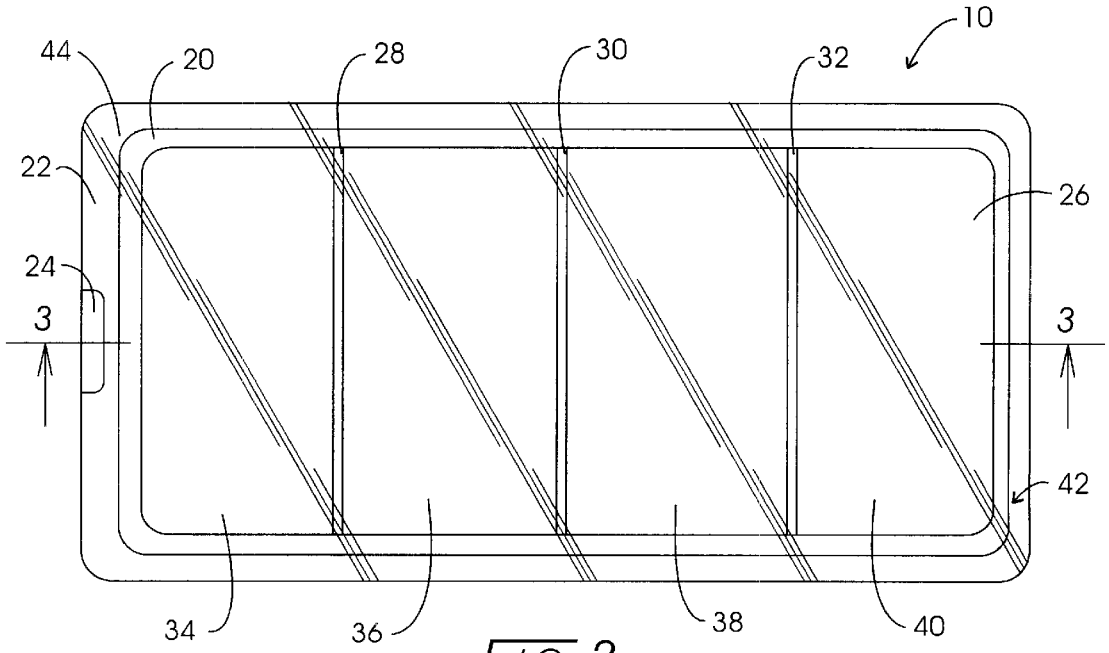
FIG. 2 is a top view of the credit card-sized carrier of FIG. 1.
Figure 3:
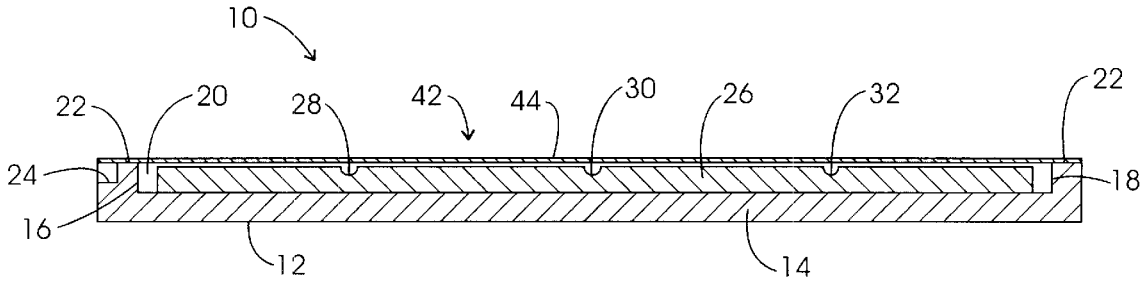
FIG. 3 is a cross-sectional view of the credit card-sized carrier of FIGS. 1 and 2 taken through the plane 3—3 shown in FIG. 2.

Cover 42 may be planar and formed of a thin, elastic film as shown at 44 in FIGS. 1–3 or cover 42 may be foil. Alternatively, cover 42 may be formed of a more rigid plastic material, as shown at 46 in FIGS. 4 and 5. As another embodiment, cover 42 may be an upper housing as shown at 48 in FIG. 6. Similar to above-described lower housing 12, upper housing 48 has a cavity, 50, that is defined by a base, 52, and connecting sidewalls 53–56 that extend to a flange, 58. A carrier having the combined cavities shown in FIG. 6 may accommodate a larger wafer than that shown in FIGS. 1–3, or the increased space may provide room for an instruction card or drug information. Regardless of its configuration (e.g., either planar or having a cavity), cover 42 is securely attached or bonded to flange 22 to provide an airtight seal, and yet cover 42 may be easily removed to dispense the enclosed medicament. Thumb notches 24 and 60 facilitate the peel removal of cover 42.

Looking to FIG. 7, indicia, such as that shown at 72, may be provided on carrier 10. Indicia 72 may be information about the drug or instructions about its use that are imprinted directly on the outside surface of plastic cover 46 or that may be reverse printed on its inside surface. Indicia 72 also may be provided on either the top or bottom surface of base 14. Rather than being printed directly on a surface of plastic cover 46 or base 14, indicia 72 may be provided as a label that is adhesively applied to a surface of the carrier. In addition to information and instructions relating to the enclosed drug, indicia 72 may be information about the user. Looking to FIG. 8, a sample information card, shown generally at 74, illustrates vital medical information that may be supplied by the user. Information card 74 may be provided to the user as a label, which after completing, the user secures to a surface of plastic cover 46.

One of the major advantages of carrier 10 is its diminutive size. During an emergency situation, medicaments often require dispensing immediately. For example, if a person is believed to be experiencing acute myocardial infarction, or a heart attack, it is prescribed that aspirin should be taken as soon as possible. However, constantly carrying aspirin may be inconvenient, especially during sports events (i.e.

hunting, fishing, etc.) or other strenuous physical activities where the likelihood of a heart attack is increased. Being credit card-sized, the carrier of the invention fits easily in a purse, pocket; wallet, or "fanny pack".

Figure 4:
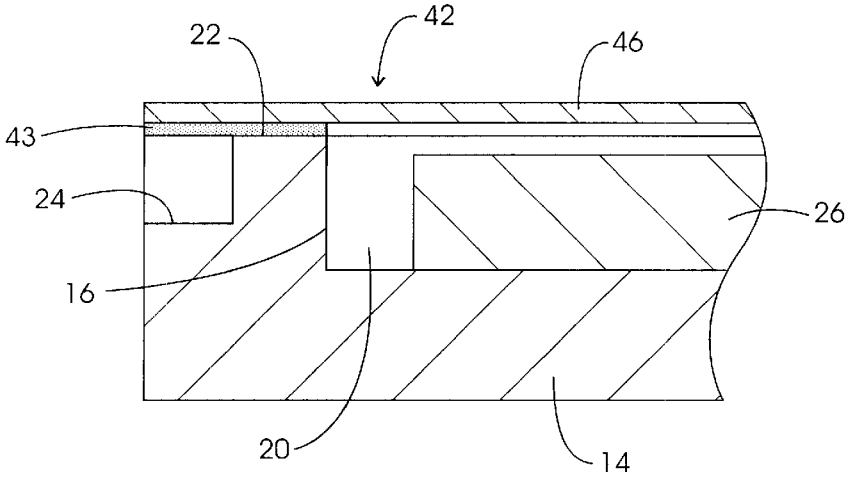
FIG. 4 is a cross-sectional view of the credit card-sized carrier of the invention with the cover formed of plastic.
Figure 5:
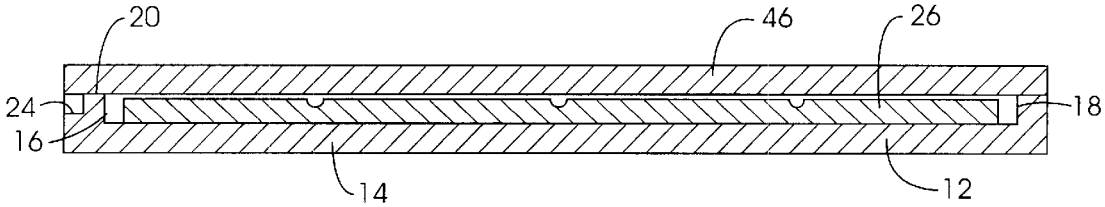
FIG. 5 is an enlarged cross-sectional view of one side of the carrier shown in FIG. 4.

To form the credit card-sized carrier, base 14 should be formed having a length of substantially no greater than about 3.5 inches and a width of substantially no greater than about 2.25 inches. Sidewalls 15–18 extend to a thickness which is slightly larger than the thickness of wafer 26. Medicament wafers may have a thickness of as thin as about 0.02 inches to about 0.1 inches. The profile of carrier 10 will vary depending on which embodiment of cover 42 is utilized. The thinnest embodiment will be that shown in FIGS. 1–3 wherein cover 42 is a thin film. As shown in FIGS. 4 and 5, carrier 10 with plastic cover 46 will have a slightly greater thickness, while the embodiment shown in FIG. 6, wherein cover 42 is an upper housing, will have the greatest thickness. Even when configured with an upper housing as cover 42, the thickness of carrier 10 will at most be equal to only about 2 to 3 times that of a standard credit card. With these dimensions, carrier 10 will easily fit anywhere a driver's license or credit card would normally be stored.

As a carrier for a medicament, the materials from which carrier 10 is formed must be carefully chosen to protect the physical integrity of the enclosed medicament and preserve its potency. These materials must be consistent with Federal Food and Drug Administration regulations that are designed to ensure the safety, quality and efficacy of drugs. Among these regulations is the requirement that the materials in which a drug is stored must not chemically react with drug itself. Such interaction between the drug and its packaging may cause the drug to be toxic when taken or may affect its potency. Also, packaging for a drug must assure that the enclosed drug retains its potency. Often, medicaments are stored for months at a time, being taken only when needed, rather than on a daily basis. Exposure to light, moisture, or gases (e.g., air) may decrease the effectiveness of a medication over time; however, if properly constructed and composed of the proper materials, a medicament carrier will preserve the potency of the medicament.

Despite the size requirements that are imposed on carrier 10, materials exist which allow the carrier to meet all governmental requirements for drug packaging. For example, lower housing 12 may be formed of a food grade plastic, (such as polyolefins (e.g., polypropylene or polyethylene), polycarbonates, polyethylene terephthalate, polyesters, acrylic resins, vinyl resins (e.g., polyvinyl acetate or the like), etc., which will not interact harmfully with most drugs, (e.g., aspirin). To protect the enclosed drug from light degradation, opacifying pigmentation may be used. UV absorbing plastics also may be used to protect the drug when the carrier is used during outdoor activities, and tintorial pigments may be used to provide the carrier with an aesthetic appeal. Food grade plastics also provide the carrier with sufficient rigidity to protect the physical integrity of the enclosed wafer, but with enough flexibility so that the carrier does not snap or break. Additional rigidity may be achieved, if needed, by fiber reinforcing the plastic. Plastic may be reinforced with an inorganic material (e.g., glass), with metallic particles, or with an organic material (e.g., graphite or carbon, aramid or other polymeric materials). Co-extruding or laminating two plastic materials together also may provide additional carrier strength. If formed of a see-through plastic, base 14 of lower housing 12 or cover 42 may be imprinted with indicia, such as information about the drug or instructions for its use. Plastic cover 46 or upper housing 48 also may be formed from a food grade plastic.

In addition to different types of food grade plastics, a number of other materials may be used to form cover 42. For example, cover 42 may be a thin, elastic film or a foil. Cover 42 also may be formed of a laminate or cellulosic material. With upper housing 12 and cover 42 being formed of materials, such as those described above, the drug enclosed within carrier 10 will be protected from exposure to light, moisture and gases. For additional protection, cavity 20, in which medicament 26 rests, may be lined with a cellulosic material that is covered in foil. The choice of material used to form carrier's lower housing and cover may vary in light of the specific medicament enclosed.

In addition to the lower housing and cover being formed of the proper materials, it is necessary that these elements be suitably bonded together. Cover 42 must be removably attached so that the medicament may be easily accessed for dispensing, but at the same time the seal between the housing and cover must be airtight to prevent the exposure of the medicament to light, gases, and particularly moisture. To form this bond or seal, the lower housing and cover may be sonic or salient welded together. Chemical adhesives also may be used. If the carrier is to be used repeatedly, for example where the medicament is a segmented aspirin wafer, pressure sensitive adhesives (e.g., acrylic, vinyl, or like PSAs) may provide a sufficiently tight but resealable bond. As with the materials used to form the lower housing and cover, the choice of adhesive may vary depending on the specific medicament housed by the carrier. The choice of cover and adhesive also may dictate the amount of flange surface area needed to provide a reliable seal. For example, sonic welding may require a smaller surface area, while a chemical adhesive may require a greater surface area. The materials chosen for the cover and lower housing also is a factor in determining the amount of flange surface area required.

With carrier 10 formed as described above, a medicament may be stored and conveniently transported for use during everyday activities. When needed, the carrier is retrieved from a wallet or pocket, the lower housing grasped and the cover removed. As described above, thumb notch 24 facilitates the removal of cover 42. Once the cover has been removed, medicament 26 may be dispensed. Where the medicament is segmented, as shown in FIG. 3, the desired dose may be broken off and the remaining wafer retained for later use. Because carrier 10 is intended to be on-hand during emergency situations, i.e. during a heart attack, the instructions printed on the lower housing or plastic cover or contained on a card within the carrier may be particularly useful to a person intervening on behalf of the patient.

Figure 9:
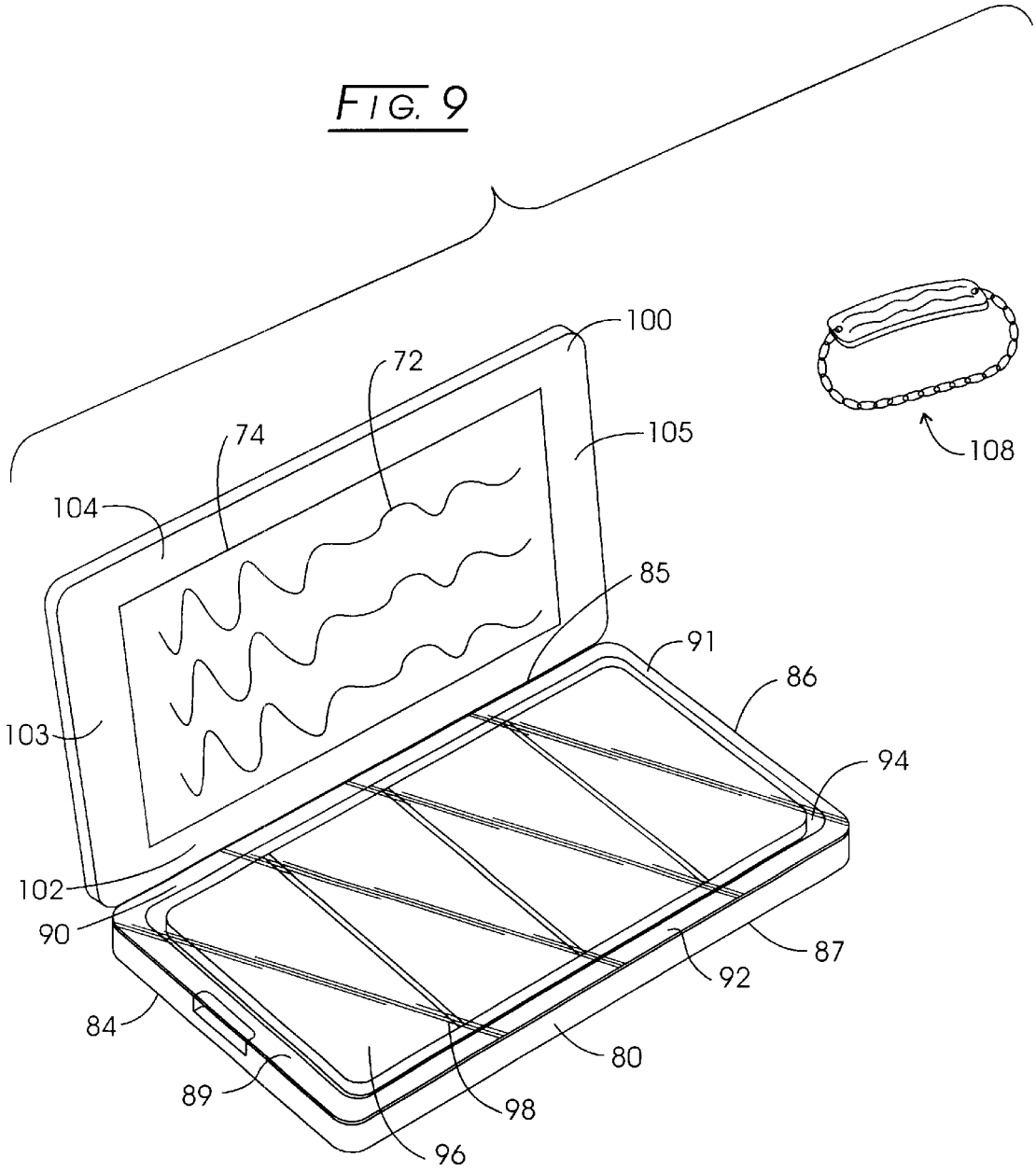
FIG. 9 is a perspective view of the credit card-sized carrier with the cover shown formed of plastic with instructions supplied thereon.

As another aspect of the invention, a credit card-sized carrier, similar to that described above, may be combined with information card 74 to form a portable medicament kit as shown in FIG. 9. The portable kit includes a credit card-sized carrier, 78, and an instruction card, such as that shown at 74 in FIG. 8. Carrier 78 includes a lower housing, 80, having a base, 82, and four connected sidewalls 84–87, each of which extends to a flange, 89–92, respectively. Base 82 and sidewalls 84–87 define a cavity 94 that houses a medicament wafer 96. Medicament wafer 96 is enclosed within cavity 94 by a first cover, 98. A second cover 100 having four sides 102–105 is hingedly attached to one sidewall of lower housing 80. In this regard, it may be seen that side 102 of cover 98 is attached to sidewall 85 of lower housing 80. However, the present invention is not limited to this arrangement. One side of cover 98 may be attached to oppositely disposed sidewall 86 or to one of the other sidewalls 85 or 87. Cover 100 may be attached to cover 98 by a living hinge made of flexible plastic. With such a hinge, the flexibility of the plastic facilitates the opening and closing of the carrier. However, the lower housing and cover may be formed from rigid materials to provide the carrier with structural integrity. One side of cover 98 also may be hingedly attached to one sidewall of lower housing 80 by an adhesive, welding methods or mechanical means. Cover 98 may be a planar covering (e.g., film, foil, plastic, etc.) or an upper housing as previously described with respect to cover 42 of carrier 10. Cover 100 may be a planar covering. The materials described above with respect to carrier 10 also may be used to form credit card-sized carrier 78.

Once the user has filled out instruction card 74, the card may be placed within carrier 78. For example, instruction card 74 may be secured to the inside of the carrier (e.g., as a label, hooks) or instruction card 74 may be loosely placed within carrier 78. Cover 98 then may be closed and removably attached to flanges 89–92. An adhesive may be provided on the inner surface of cover 98 or on the upper surface of cover 100. Regardless of where the adhesive is located, because of the hinged connection between one side of cover 98 and lower housing 80, the remaining sides of cover 98 are configured to mate with the flanges of corresponding sidewalls 84–87, respectively. After being sealed, carrier 78 may be used to store and transport medicament 96 until needed. Cover 100 functions to protect medicament wafer 96 from exposure to light, air, or moisture if cover 98 is provided to the patient in an open configuration as shown in FIG. 9. Cover 100 also may serve as a tamper resistant seal. While providing carrier with two seals or covers may be advantageous, cover 100 may not always be needed. If cover 100 is attached to lower housing 80 with a pressure sensitive adhesive, for example, then cover 98 may not be necessary. In that instance, cover 100 may be sealed to protect medicament wafer 96 until the patient completes information card 74. Then, cover 100 may be removed, card 74 placed inside, and cover 100 reattached to reseal cavity 94.

Because medicament wafer 96 is of greatest value during emergency situations, the medicament kit also may include an alert, such as a bracelet or necklace shown generally at 108 in FIG. 9, indicating that the patient possesses carrier 78. When the patient is wearing an alert, if intervention is necessary (i.e. where the patient is unconscious otherwise unable to communicate), a person intervening during the emergency will know to locate carrier 78 and dispense medicament wafer 96.

The disclosure herein is illustrative of the present invention that should be understood to include various variations, modifications, and equivalents to those disclosed herein as those skilled in the art will appreciate. In this application, all references are incorporated herein by reference.

What is claimed is:

1. A carrier assembly which comprises:

(a) a credit card-sized carrier for carrying a medicament wafer during everyday activities including a lower housing having a cavity defined by a flat base and connected sidewalls which terminate in a flange, said carrier having the capability of protecting the structural integrity and potency of said medicament wafer when said wafer is housed within said cavity;

(b) a medicament wafer housed within said cavity; and (c) a cover removably attached to said flange and enclosing said cavity.

2. The carrier assembly of claim 1, wherein said medicament wafer has a thickness of about 0.02 inches to about 0.1 inches.

3. The carrier assembly of claim 1, wherein said base of said lower housing has a length not exceeding about 3.5 inches and a width not exceeding about 2.25 inches.

4. The carrier assembly of claim 1, wherein said medicament wafer is composed of two or more separably adjoined segments.

5. The carrier assembly of claim 1, wherein said medicament wafer is aspirin.

6. The carrier assembly of claim 1, wherein one of said sidewalls of said lower housing includes a notched flange for peeling said cover.

7. The carrier assembly of claim 1, wherein said cover is a thin, elastic film.

8. The carrier assembly of claim 1, wherein said cover is foil.

9. The carrier assembly of claim 1, wherein said cover is formed of a cellulosic material.

10. The carrier assembly of claim 1, wherein said cover is formed of a laminate material.

11. The carder assembly of claim 1, wherein said cover removably attached to said lower housing with adhesive.

12. The carrier assembly of claim 1, wherein said cover is an upper housing having a cavity defined by a flat base and connected sidewalls which terminate in a flange.

13. The thin carrier of claim 1, wherein one or more of said cover or said base of said lower housing bears indicia.

14. The carrier assembly of claim 1, wherein one or more of said upper housing or said lower housing is fiber reinforced.

15. The carrier assembly of claim 1, wherein one or more of said base or said cover is a food grade plastic.

16. A method for enabling a person to carry a medicament during everyday activities, which comprises the step of:

providing a credit card-sized carrier which houses a medicament wafer, wherein said carrier is comprised of a lower housing having a cavity defined by a flat base and connected sidewalls which terminate in a flange, a cover removably attached to said flange and enclosing said cavity, and said medicament wafer being housed within said cavity.

17. The method of claim 16, wherein said credit card-sized carrier is provided with said medicament wafer having a thickness of about 0.02 inches to about 0.1 inches.

18. The method of claim 16, wherein said credit card-sized carrier is provided with said base of said lower housing having a length not exceeding about 3.5 inches and a width not exceeding about 2.25 inches.

19. The method of claim 16, wherein said credit card-sized carrier is provided with said medicament wafer being composed of two or more separably adjoined segments.

20. The method of claim 16, wherein said credit card-sized carrier is provided with said medicament wafer being aspirin.

21. The method of claim 16, wherein said credit card-sized carrier is provided with one of said sidewalls of said lower housing including a notched flange for peeling said cover.

22. The method of claim 16, wherein said credit card-sized carrier is provided with said cover being a thin, elastic film.

23. The method of claim 16, wherein said credit card-sized carder is provided with said cover being foil.

24. The method of claim 16, wherein said credit card-sized carrier is provided with said cover being formed of a cellulosic material.

25. The method of claim 16, wherein said credit card-sized carrier is provided with said cover being formed of a laminate material.

26. The method of claim 16, wherein said credit card-sized carrier is provided with said cover being removably attached to said lower housing with adhesive.

27. The method of claim 16, wherein said credit card-sized carrier is provided with said cover being an upper housing having a cavity defined by a flat based and connected sidewalls which terminate In a flange.

28. The method of claim 16, wherein said credit card-sized carrier is provided with one or more of said cover or said base of said lower housing bearing indicia.

29. The method of claim 16, wherein said credit card-sized carrier is provided with one or more of said lower housing or upper housing being fiber reinforced.

30. The method of claim 16, wherein said credit card-sized carrier is provided with one or more of said base or said cover being formed of a food grade plastic.

* * * * *